US005352241A

United States Patent [19]

Schade et al.

[11] Patent Number: 5,352,241

[45] Date of Patent: Oct. 4, 1994

[54] PROCESS FOR RETANNING MINERAL TANNED LEATHERS WITH AROMATIC SULPHONIC ACIDS

[75] Inventors: Franz Schade, Bergisch Gladbach; Wilhelm Krümmel, Leverkusen; Bernhard Wehling, Bergisch Gladbach; Henricus Slaats, Leverkusen, all of Fed. Rep. of Germany

[73] Assignee: Bayer Aktiengesellschaft, Leverkusen, Fed. Rep. of Germany

[21] Appl. No.: 41,294

[22] Filed: Mar. 29, 1993

Related U.S. Application Data

[63] Continuation of Ser. No. 738,703, Jul. 31, 1991, abandoned.

[30] Foreign Application Priority Data

Aug. 10, 1990 [DE] Fed. Rep. of Germany ..... 4025344

[51] Int. Cl.[5] ..... C14C 3/08; C14C 3/20

[52] U.S. Cl. ..... 8/94.21; 8/94.33; 252/8.57

[58] Field of Search ..... 8/94.21, 94.33, 94.2, 8/94.19; 252/8.57

[56] References Cited

U.S. PATENT DOCUMENTS

| | | | |
|---|---|---|---|
| 2,249,757 | 7/1941 | Flett | 8/94.33 |
| 2,409,671 | 10/1946 | Faust | 8/94.21 |
| 2,973,240 | 2/1961 | Schmitt | 8/94.33 |
| 4,830,632 | 5/1989 | Lauton | 8/94.33 |

FOREIGN PATENT DOCUMENTS

| | | | |
|---|---|---|---|
| 24014 | 2/1981 | European Pat. Off. . | |
| 239956 | 3/1946 | Switzerland . | |
| 175250 | 3/1923 | United Kingdom | 8/94.21 |
| 317834 | 2/1931 | United Kingdom | 8/94.21 |

*Primary Examiner*—Prince Willis, Jr.

*Assistant Examiner*—Alan D. Diamond

*Attorney, Agent, or Firm*—Sprung Horn Kramer & Woods

[57] ABSTRACT

Process for retanning mineral-tanned leathers, characterised in that the retanning agents used are sulphonic acids and/or salts thereof of the general formula

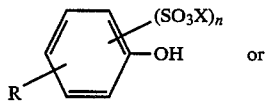

(I)

or

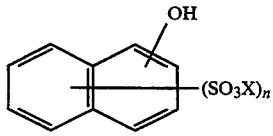

(II)

wherein

R represents hydrogen, $-CH_3$ or the radicals

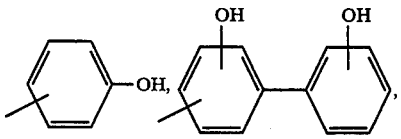

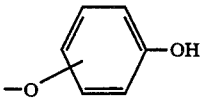

X represents hydrogen, an alkali metal ion, especially sodium, potassium or lithium ion, or an ammonium ion and n represents 1, 2, 3 or 4.

2 Claims, No Drawings

PROCESS FOR RETANNING MINERAL TANNED LEATHERS WITH AROMATIC SULPHONIC ACIDS

This application is a continuation of application Ser. No. 738,703, filed Jul. 31, 1993 now abandoned.

The invention relates to a process for retanning mineral-tanned leathers, especially those tanned with chromium tanning agents, with sulphonic acids and/or salts thereof, of the general formulae

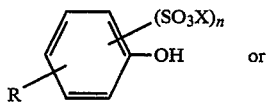

(I)

or

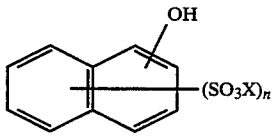

(II)

wherein

R represents hydrogen, —$CH_3$ or the radicals

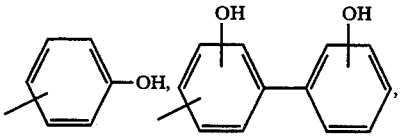

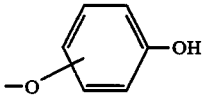

X represents hydrogen, an alkali metal ion, especially sodium, potassium or lithium ion, or an ammonium ion and n represents 1, 2, 3 or 4.

Preferably, the monosulphonic and disulphonic acids of phenol, cresols, hydroxydiphenyls and naphthols and also the alkali metal salts and ammonium salts thereof are used.

As retanning agents and as aids for levelling chemical and/or physical irregularities in the leather surface, for example formaldehyde condensation products of β-naphthalenesulphonic acid (German Patent Specification 290,965), of diphenylsulphonic and ditolylethersulphonic acids (US Pat. No. 2,315,951) and of terphenylsulphonic acids (US Pat. No. 3,906,037) and also ammonium salts or alkali metal salts thereof are usual. So-called substitute tanning agents, which predominantly are in the form of phenol-containing formaldehyde condensation products of aromatic sulphonic acids or salts thereof, are also usual in practice as retanning agents and/or levelling agents for chrome leather (British Patent Specification 1,291,784 and East German Patent Specification 611,671).

The disadvantage of these higher-molecular anionic retanning agents and levelling agents is that, in interaction with anionic dyestuffs, they are preferentially absorbed on the leather surface and here block possible bonding sites for anionic dyestuffs. This inevitably has the result that the dyestuffs are predominantly fixed more deeply down in the leather.

Admittedly, very uniform surface dyeings which, however, are considerably lighter in colour as compared with dyeing without anionic levelling agents, are obtained in this way. Only a part of the dyestuff offered is utilised for the surface dyeing. Thus, if high levelness of the dyeing is demanded, losses in depth of colour, caused by the additional use of anionic retanning agents and levelling agents, have hitherto had to be accepted.

Although there are gradual differences in the lightening action on dyeings between the various types of tanning agents and levelling agents, which differences depend, inter alia, on the ratio of the levelling agents and/or retanning agents to the dyestuff and can be specific to a dyestuff, they always effect high losses in depth of colour on leather, which can reach 50–80%, if compared with leathers which are dyed under comparable conditions but without a treatment with retanning agents or levelling agents.

If, for producing deep dyeings on heavily retanned leathers, the leather surface is cationically recharged by cationic auxiliaries or by mineral tanning agents before the dyeing, frequently similar defects in levelness occur, such as are observed in the dyeing of pure leather which has not been treated with anionic tanning agents, retanning agents or levelling agents.

It has been found, surprisingly, that the sulphonic acids of the formulae (I) and (II) and salts thereof, which have not been condensed, like anionic synthetic tanning agents and levelling agents, with formaldehyde to give larger molecules, are outstandingly suitable as retanning agents. They have the advantage that the leathers retanned with these or the leathers treated before or during dyeing give deep and brilliant surface dyeings with anionic dyestuffs, coupled with excellent levelness. The resulting depth of colour is here similar to that of pure chrome leathers which have not been treated with retanning agents and/or levelling agents.

Phenolsulphonic acid which have been partially or completely neutralised with sodium hydroxide or with ammonia are preferably suitable as retanning agents of the formulae (I) and (II), which allow a deep and brilliant dyeing of the leather coupled with optimum utilisation of the dyestuff offered. They can be prepared, for example, by allowing 2 moles of sulphuric acid monohydrate to act on 1 mole of technical phenol at 110°–130° C., preferably 120° C., for 2 hours for sulphonation and then neutralising the reaction mixture to the desired end pH value and converting by spray-drying into powder or forming it as a liquid product with about 40% of active substance.

The optimum effectiveness with respect to levelness, brilliance and depth of the dyeing of the leather is obtained when the sulphonic acids and salts thereof of the formula (I) or (II) are allowed, before or during the dyeing with anionic dyestuffs, to act on the leather and to be absorbed thereon in quantities of 2–10%, preferably 3–6% (relative to the so-called shaved weight of the leather). They level the dyeing and equalise the differing dyeability of damaged and undamaged areas within individual skins or hides particularly well if they are applied to the leather before the addition of dyestuff and the dyestuff can then be uniformly absorbed on the levelled leather.

The compounds of the formula (I) or (II) can also be applied to leather in combination with other tanning agents and auxiliaries. For example, they can be combined with chromium tanning agents which are frequently used in practice for retanning together with synthetic tanning agents to increase the fullness and to determine the character of the leather. Expediently, basifying agents and/or neutralising agents, such as sodium sulphite, soda or alkali metal salts or alkaline earth metal salts of organic carboxylic acids such as formic acid, acetic acid or technical dicarboxylic acid mixtures, are in addition also added, in quantities matched to the chromium tanning agent content, to the combination. If, for example, an improvement in leather fullness and softness and at the same time good dyeability are demanded, the following combination of 40–80 parts by weight of a 33% basic chromium sulphate, 40–20 parts by weight of the sodium salt proves suitable.

Mixtures of the sulphonic acids used according to the invention, and/or salts thereof, especially the sodium salts or ammonium salts with monobasic or polybasic, preferably dibasic, carboxylic acids, for example formic acid, acetic acid, propionic acid, succinic acid, glutaric acid, adipic acid and/or alkali metal (Na, K, Li) salts, ammonium salts or alkaline earth metal (Mg, Ca, Sr, Ba) salts thereof, also prove to be particularly suitable for simultaneous neutralisation and levelling retanning.

As an example, a mixture may be mentioned which contains 70–40 parts by weight of sodium salts of a technical dicarboxylic acid mixture (mixture of succinic, glutaric and adipic acids) such as is inevitably obtained as a biproduct, for example, in the production of adipic acid, and 30–60 parts by weight of sodium salts and/or ammonium salts of phenolsulphonic acid.

EXAMPLE 1

Chrome leathers, produced in the usual way, shaved to 1.6–1.8 mm and neutralised to pH 3.8–4.2 from cow hides or calf skins are treated at 100% liquor in a rotating tanning tumbler with 6% of an ammonium phenolsulphonate adjusted to pH 6.5–6.8, which is formed when 2 moles of sulphuric acid monohydrate are allowed to act on 1 mole of phenol at 120° C. in the course of 2 hours and the product is then, after cooling and dilution, neutralised with ammonia up to pH 6.5–6.8 and spray-dried to give a powder or formed as a liquid product with about 40% of active substance.

After this pretreatment of the leather, dyeing is carried out in the usual manner with 1% of the copper complex of a monoazo dyestuff from German Patent Specification 670,935, Example 1.

After dyeing, the product is fat-liquored in the dye bath in the usual manner and then aftertreated with 1.5% of formic acid, in order to obtain optimum absorption of the dyestuff and the fat liquor.

After drying and stretching of the leather, a full soft leather having an extremely brilliant and deep surface dyeing results.

In the depth of colour, this leather corresponds to a leather which has been dyed with the same quantity of dyestuff without pretreatment with auxiliaries, but which is obtained with a markedly lower levelness.

A chrome leather which was treated under the same conditions with the Na salt of the terphenylsulphonic acid-formaldehyde condensate, which was prepared according to US Pat. No. 3,906,037, Example 3, instead of the phenol salt, has a greatly lightened, pale colouring.

EXAMPLE 2

Chrome cow-hide leathers shaved in the usual manner to 1.6–1.8 mm thickness and neutralised to pH 3.6–3.8 are treated, for initiating retanning, in 100% of warm liquor at 40° C. for 10 minutes with 4% of a phenolsulphonate. To prepare the sulphonate, 2 moles of sulphuric acid monohydrate are allowed to act on 1 mole of phenol at 120° C. in the course of 2 hours with intensive stirring, the reaction mixture is cooled down, diluted, neutralised with sodium hydroxide solution and converted by spray-drying into the form of powder.

After the treatment described above, intensive retanning with 2% in each case of a phenolic tanning agent, a resin tanning agent based on dicyanodiamide and a vegetable tanning agent, preferably mimosa extract, follows in the same bath. After 45 minutes, the tanning agents have been fully absorbed and the liquor can be drained off. Dyeing is then carried out, also in the usual manner, in a fresh liquor with 2% of the anionic metal complex dyestuff Acid Brown 85 (C.I. 34 900). Fat-liquoring and further finishing are likewise carried out in the usual manner. The finished leather is obtained with full, brilliant and equally level dyeing of the character of chrome side leather made from native hides.

The improvement of the dyeability and especially of the depth of colour, of the brilliance and the levelness are particularly manifest if a comparative test is carried out in which, in place of the sodium salt, the condensation product of diphenyl ether sulphonic acid and formaldehyde, obtained according to US Pat. No. 2,315,951, Example 1, is used.

EXAMPLE 3

To produce nubuck leathers, chrome leathers shaved in the usual manner and neutralised to pH 6.0 (bromothymol blue colouring of a cut yellow to yellow-green) are first washed in the usual manner with 300% of water at 40° C. After draining off the washing liquor, the leather is prestuffed with 2.5% of a sulphited fish oil-based leather-fatting agent for 15 minutes in 100% of a warm liquor at 40° C. and then treated in the same liquor for 10 minutes with 1% of an ammonia solution which contains 2.5 percent by weight of $NH_3$. 2.5% of the anionic metal complex dyestuff Acid Brown 85 (C.I. 34 900) are then added together with 2% of a potassium phenolsulphonate and 2% of a sweetened chestnut wood extract, and dyeing and retanning are carried out simultaneously for 90 minutes. After this treatment, 100% of water at 70° C. are added and allowed to act for 10 minutes, before acidification in the same liquor for 40 minutes with 1.5% of formic acid solution (down to pH 3.8), which contains 8.5 percent by weight of pure formic acid. After draining off the liquor, the leather is overdyed in a new bath in 100% liquor at 55° C. with a further 1.5% of the same dyestuff as in the pretreatment and then fat-liquored with a fat mixture based on wool fat and chloroparaffinsulphonate. Finally, it is aftertreated with 2.5% of sweetened chestnut wood extract and once more acidified with 0.5% of a formic acid solution which contains 8.5 percent by weight of pure formic acid. At an end pH value of 3.8, the leathers are rinsed in the usual way and stored overnight on a horse. After samming, vacuum drying for ½ minute at 80° C. and 50% counterpressure, drying of the suspended leathers, conditioning, staking and repeated vacuum drying for ½ minute at 80°–90° C. are carried out. At a residual moisture content of 18–20%, the grain side is then ground with 220–230 grinding paper in 3–4 passes, depending on the nature of the grain.

With this procedure, full and soft nubuck leathers result which are distinguished by high brilliance and levelness of the dyeing and very fine uniform grinding.

The abovementioned potassium phenolsulphonate is prepared by reacting 98 g of sulphuric acid monohydrate with 1 mole of phenol at 120° C. for 120 minutes and neutralisation with potassium hydroxide.

We claim:

1. A process for retanning mineral-tanned leathers, said process comprising contacting the mineral-tanned leathers with a retanning agent, said retanning agent selected from the group consisting of sulphonic acids or salts thereof having the formula:

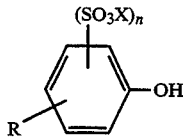

(I)

wherein

R represents one of the radicals:

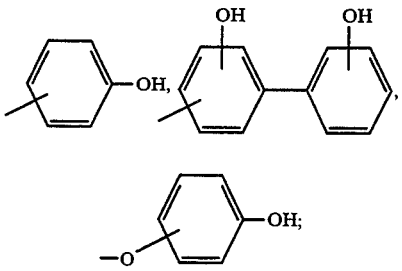

X represents hydrogen, an alkali metal ion or an ammonium ion; and n represents 1, 2, 3 or 4.

2. A process for retanning mineral-tanned leathers, said process comprising contacting the mineral-tanned leathers with a retanning agent, said retanning agent selected from the group consisting of sulphonic acids or salts thereof having the formula:

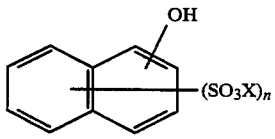

(II)

wherein

X represents hydrogen, an alkali metal ion or an ammonium ion; and n represents 1, 2, 3 or 4.

* * * * *